US012534876B2

(12) United States Patent
Sekine et al.

(10) Patent No.: US 12,534,876 B2
(45) Date of Patent: Jan. 27, 2026

(54) WORK MACHINE CONTROL SYSTEM, AND WORK MACHINE

(71) Applicant: HITACHI CONSTRUCTION MACHINERY CO., LTD., Tokyo (JP)

(72) Inventors: Kazuya Sekine, Mito (JP); Hidekazu Moriki, Mito (JP); Shinya Imura, Toride (JP); Yoshiaki Tsutsumi, Ishioka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 138 days.

(21) Appl. No.: 18/279,477

(22) PCT Filed: Aug. 26, 2022

(86) PCT No.: PCT/JP2022/032212
§ 371 (c)(1),
(2) Date: Aug. 30, 2023

(87) PCT Pub. No.: WO2023/047885
PCT Pub. Date: Mar. 30, 2023

(65) Prior Publication Data

US 2024/0301656 A1 Sep. 12, 2024

(30) Foreign Application Priority Data

Sep. 24, 2021 (JP) ..... 2021-155407

(51) Int. Cl.
*E02F 9/20* (2006.01)
*E02F 9/24* (2006.01)

(52) U.S. Cl.
CPC ..... *E02F 9/2045* (2013.01); *E02F 9/24* (2013.01)

(58) Field of Classification Search
CPC . E02F 9/2045; E02F 9/24; E02F 3/434; E02F 9/262; E02F 9/268; E02F 9/2025; B60Y 2200/415
See application file for complete search history.

(56) References Cited

U.S. PATENT DOCUMENTS 5,987,379 A * 11/1999 Smith ..... G08B 21/0288 701/493
2014/0107882 A1* 4/2014 Tojima ..... E02F 9/207 701/23
2017/0259813 A1* 9/2017 Wokoeck ..... B60W 10/20

FOREIGN PATENT DOCUMENTS

JP 2000-29525 A 1/2000
JP 2018-181120 A 11/2018
(Continued)

OTHER PUBLICATIONS

English translation of Iwase et al. (JP 2019174890) (Year: 2019).*
(Continued)

*Primary Examiner* — Kyle J Kingsland
(74) *Attorney, Agent, or Firm* — MATTINGLY & MALUR, PC

(57) ABSTRACT

An action management section 211 acquires a work instruction 230, which includes a final target position, and a current position of a work machine 100 to set a target position, a route planning section 212 generates a target route 240 between the current position and the target position, an operation generation section 213 causes the work machine 100 to travel in accordance with the target route 240, and upon receiving an evacuation instruction 250 including evacuation possible positions based on a work range of another work machine different from the work machine 100, the action management section 211 decides an evacuation position from among the evacuation possible positions based on the work range of the other work machine and at
(Continued)

300 least one of the current position and final target position of the work machine 100 to set it to the target position.

7 Claims, 11 Drawing Sheets

(56) References Cited

FOREIGN PATENT DOCUMENTS

| | | | | |
|---|---|---|---|---|
| JP | 2018-193038 | A | | 12/2018 |
| JP | 2019174890 | A | * | 10/2019 |
| JP | 2019214831 | A | * | 12/2019 |
| JP | 2020-28259 | A | | 2/2020 |
| JP | 2021-31940 | A | | 3/2021 |
| WO | 2015/087430 | A1 | | 6/2015 |
| WO | 2020/217977 | A1 | | 10/2020 |

OTHER PUBLICATIONS

English translation of Hirano et al. (JP 2019214831) (Year: 2019).*
International Search Report of PCT/JP2022/032212 dated Oct. 25, 2022.

* cited by examiner

220

| 221 | 222 COORDI-NATES | 223 ATTRIBUTES |
|---|---|---|
| p0 | x0,y0 | |
| p1 | x1,y1 | Q2:EXCAVATION TARGET |
| p2 | x2,y2 | R2:LOADING TARGET |
| p3 | x3,y3 | |
| p4 | x4,y4 | |
| p5 | x5,y5 | |
| p6 | x6,y6 | R1:LOADING TARGET |
| p7 | x7,y7 | |
| p8 | x8,y8 | Q1:EXCAVATION TARGET |
| p9 | x9,y9 | |
| p10 | x10,y10 | O1:OBSTACLE |

220

| 224 | 225 Start | 226 End |
|---|---|---|
| l0 | p0 | p3 |
| l1 | p3 | p2 |
| l2 | p3 | p4 |
| l3 | p3 | p7 |
| l4 | p4 | p1 |
| l5 | p4 | p5 |
| l6 | p7 | p6 |
| l7 | p7 | p8 |
| l8 | p7 | p9 |
| | | |
| | | |

FIG. 7A

230

| 231 ID | 232 OBJECT | 233 TARGET AMOUNT OF LOADING | 234 LOADING POSITION | 235 EXCA-VATION POSITION | 236 DUMPING POSITION |
|---|---|---|---|---|---|
| Ins01 | M1 | W1 | R1 | Q1 | Q1 |
| Ins02 | M2 | W2 | R2 | Q2 | Q2 |
| | : | : | : | : | : |

FIG. 7B

240

| 241 POINT | 242 FNR |
|---|---|
| p3 | |
| p7 | F |
| p8 | F |

FIG. 7C

240

| POINT | FNR |
|---|---|
| p3 | - |
| p0 | R |

FIG. 7D

240

| POINT | FNR |
|---|---|
| p0 | - |
| p3 | F |
| p7 | F |
| p8 | F |

FIG. 7E

250

| 251 ID | 252 EVACUATION POSSIBLE POSITION |
|---|---|
| Eva01 | p0、p2、p5、p6 |
| | : |

FIG. 11A

250

251 252

| ID | EVACUATION POSSIBLE POSITION |
|---|---|
| Eva01 | p2、p5、p6 |
| | : |

FIG. 11B 240a

| POINT | FNR |
|---|---|
| 0 | - |
| 3 | F |
| 2 | F |
| 3 | R |
| 0 | R |
| 3 | F |
| 7 | F |
| 8 | F |

FIG. 11C 240b

| POINT | FNR |
|---|---|
| 0 | - |
| 3 | F |
| 7 | F |
| 6 | F |
| 7 | R |
| 9 | R |
| 7 | F |
| 8 | F |

WORK MACHINE CONTROL SYSTEM, AND WORK MACHINE

TECHNICAL FIELD

The present invention relates to a work machine control system and a work machine.

BACKGROUND ART

There have been proposed work machines, which automatically excavate objects to be excavated and load the excavated objects onto a predetermined loading position, and control systems for such work machines. In work sites, dump trucks and other work machines for bringing materials may enter, and thus the work machines, which autonomously operate, need to continue the work with avoiding contact with the dump trucks and other work machines.

For example, Patent Literature 1 discloses a driving assistance technique for, when driving cannot be switched from autonomous driving to manual driving, making the vehicle evacuate to a predetermined place based on route information set in the vehicle and wait therein until manual driving by a driver is available so that the driving can be taken over.

Patent Literature 2 discloses an autonomous travelling controller for autonomous travelling based on a road structure map, which is configured to, in case that autonomous travelling cannot be controlled, make a vehicle evacuate to a road shoulder of a zone where a wire rope protection fence is installed.

CITATION LIST

Patent Literature

Patent Literature 1: JP-A-2018-181120
Patent Literature 2: JP-A-2018-193038

SUMMARY OF INVENTION

Technical Problem

The techniques disclosed in Patent Literature 1 and Patent Literature 2 are directed to vehicles that travel on public roads, and only consider making the vehicle move out safely. However, for making a work machine, which travels within a work area while performing work, evacuate, it is necessary to consider the traveling routes of the dump trucks and other work machines that work in the work area, and also the work efficiency. Neither of the cited documents considers the traveling routes of the dump trucks and other work machines that work in the work area, nor decrease in the work efficiency caused by evacuation.

The present invention has been made in view of the circumstances above, and an object of the present invention is to provide a work machine control technique for minimizing decrease in the work efficiency caused by evacuation while avoiding contact with a dump truck and other work machines.

Solution to Problem

In order to achieve the object described above, a representative aspect of the present invention is a work machine control system, comprising a controller configured to cause the work machine to operate, wherein the controller includes: an action management section configured to acquire a work instruction, which includes information about a work to be executed by the work machine, and a current position of the work machine so as to set a target position based on the work instruction and the current position; a route planning section configured to generate a target route between the current position and the target position; and an operation generation section configured to cause the work machine to travel in accordance with the target route, and the action management section is configured to: receive an evacuation instruction including evacuation possible positions based on a work range of another work machine that is different from the work machine, and upon receiving the evacuation instruction, decide an evacuation position from among the evacuation possible positions based on the work range of the other work machine and the current position of the work machine so as to set the evacuation position to the target position.

Advantageous Effects of Invention

According to the present invention, it is possible to minimize decrease in the work efficiency caused by evacuation while avoiding contact with other work machines. The problems, configurations, and advantageous effects other than those described above will be clarified by explanation of the embodiments to be described below.

BRIEF DESCRIPTION OF DRAWINGS

FIG. 7(*a*) is a diagram for explaining examples of work instructions according to the first embodiment, FIG. 7(*b*) to FIG. 7(*d*) are diagrams for explaining a target route according to the first embodiment, and FIG. 7(*e*) is a diagram for explaining an example of an evacuation instruction according to the first embodiment.

FIG. 11(*a*) is a diagram for explaining an example of an evacuation instruction according to a third embodiment, and FIG. 11(*b*) and FIG. 11(*c*) are diagrams for explaining target route candidates according to the third embodiment.

DESCRIPTION OF EMBODIMENTS

Figure 1:
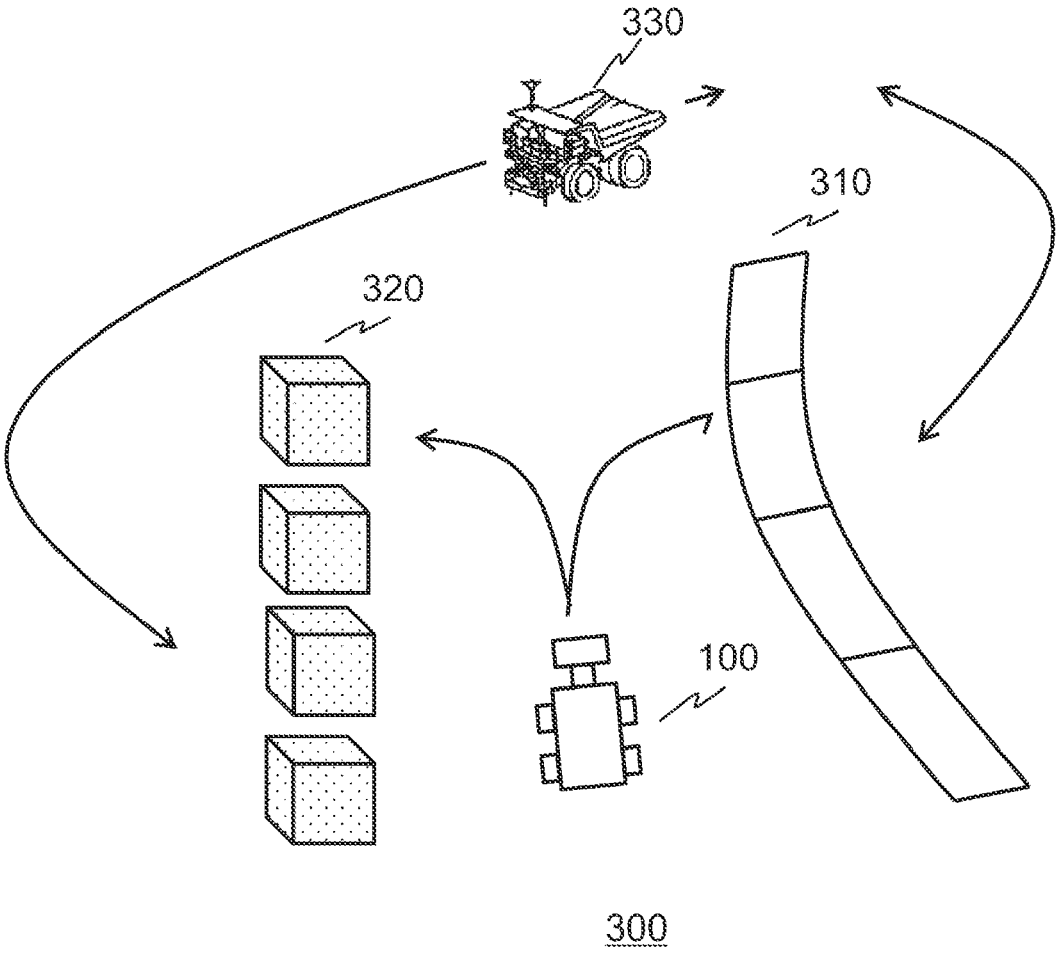
FIG. 1 is a diagram for explaining the outline of a first embodiment.

Hereinafter, embodiments of a work machine control system according to the present invention will be described with reference to the drawings.

First Embodiment

First, an outline of a first embodiment will be described with reference to FIG. 1. In the present embodiment, a work machine 100 such as a wheel loader, which autonomously travels within a work area 300, repeatedly excavates an excavation target 310 and carries the object as excavated to a loading target 320 in accordance with a work instruction. In this work area 300, a transport vehicle 330 which operates differently from the work machine 100 enters. The transport vehicle 330 is, for example, a dump truck or the like which transports an object loaded on the loading target 320 to the outside of the work area 300 or supplies the excavation target 310. Note that a management device (computer provided in a management center) for controlling the whole of the work area may be provided.

In the present embodiment, when the transport vehicle 330 enters the work area 300, an evacuation instruction is transmitted to the control system 180 (see FIG. 3) of the work machine 100. Upon receiving the evacuation instruction, the control system 180 of the work machine 100 performs control so as to make the work machine 100 move off to an evacuation position in which decrease in the work efficiency can be minimized.

Hereinafter, the work machine 100 and the control system 180 for the work machine 100 which can realize the above will be described. In the following, a wheel loader exemplified as the work machine 100 will be described.

Figure 2:
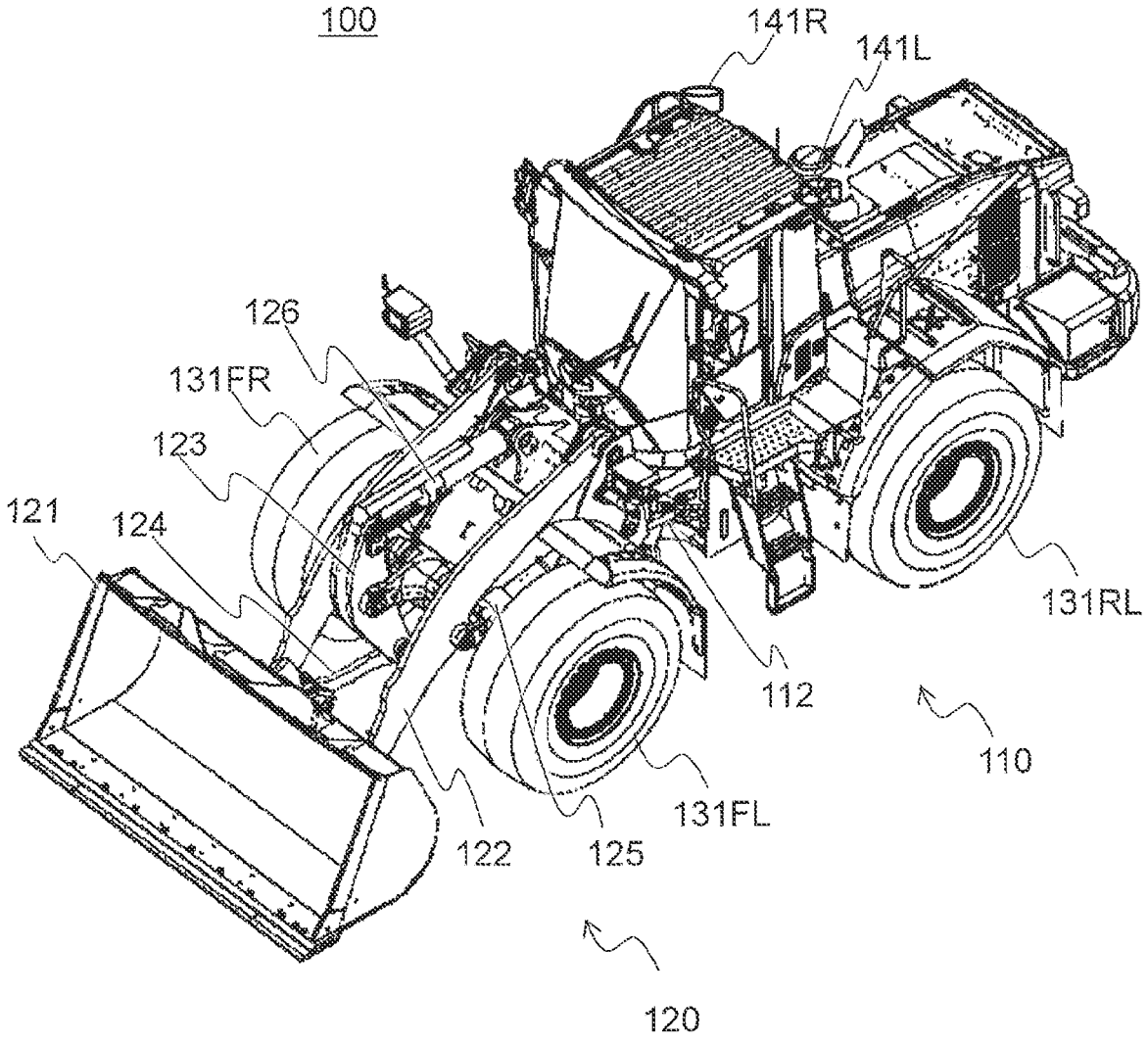
FIG. 2 is a schematic diagram of appearance of a wheel loader according to the first embodiment.
Figure 3:
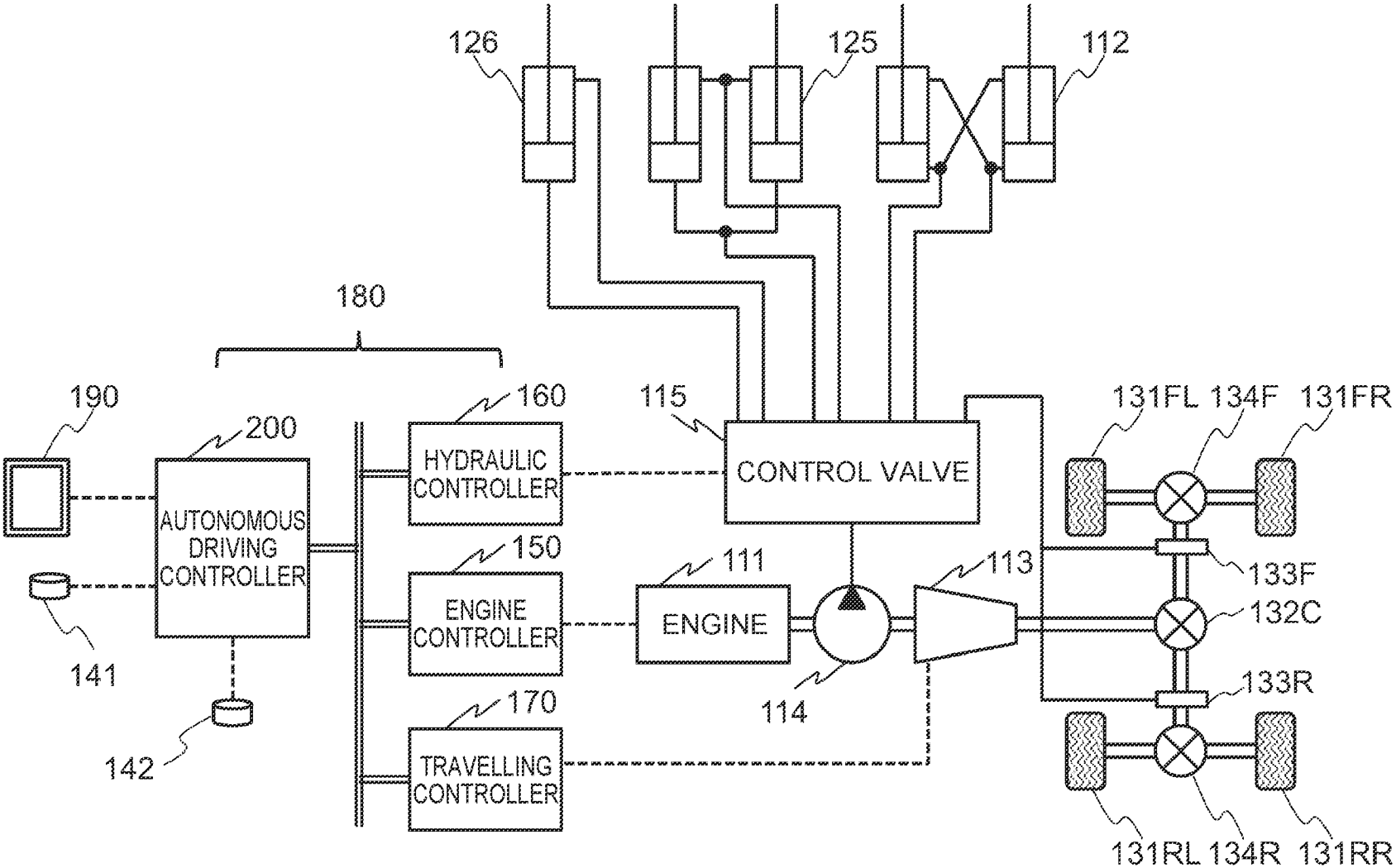
FIG. 3 is a configuration diagram of a control system of a wheel loader according to the first embodiment.

FIG. 2 schematically illustrates the appearance of the wheel loader 100 according to the present embodiment, and FIG. 3 illustrates the control system 180 of the wheel loader 100 according to the present embodiment.

The wheel loader 100 includes a vehicle body 110 and an articulated working device 120 mounted on a front portion of the vehicle body 110.

The working device 120 is a working device driven by at least one actuator. The working device 120 illustrated in FIG. 2 includes a bucket 121, lift arms 122, a bell crank 123, a bucket link 124, lift cylinders 125, a bucket cylinder 126, and steering cylinders 112.

The bucket 121 is work equipment provided on a front portion of the vehicle body. The lift cylinders 125 and the bucket cylinder 126 are hydraulic actuators (hydraulic cylinders) for driving the lift arms 122 and the bucket 121, respectively, and are attached between the working device 120 and the vehicle body 110. On the left and right sides of the vehicle body 110, the lift arms 122 and the lift cylinders 125 are provided, one for each.

The lift arm 122 is rotatably supported on the vehicle body 110, and rotates (raised and lowered) in the vertical direction in accordance with the driving by the expansion and contraction of the lift cylinders 125. The bucket 121 rotates (dump operation or tilt operation) in accordance with the driving by the expansion and contraction of the bucket cylinder 126.

In the lift cylinder 125, one end is connected to the lift arm 122 and the other end is connected to the vehicle body 110. In the bucket cylinder 126, one end is connected to the bell crank 123, and the other end is connected to the vehicle body 110. The linkage mechanism for causing the bucket 121 of the wheel loader 100 illustrated in FIG. 2 to operate is a Z-link (bell crank) mechanism using the bell crank 123.

The vehicle body 110 is provided with four wheels (front right tire 131FR, front left tire 131FL, rear right tire 131RR (see FIG. 2), and rear left tire 131RL). Hereinafter, they will be collectively referred to as "tires 131" unless it is necessary to distinguish them. Each of the tires 131 is driven by a power transmission device that is driven by an engine 111 (see FIG. 3). Transmission of the driving force to the ground through the tires 131 causes the wheel loader 100 to travel forward or reverse.

The wheel loader 100 further includes an articulation typed steering mechanism, which causes a difference in angle between the front side of the vehicle body and the rear side of the vehicle body with an axis in the vertical direction of the vehicle body, so as to make the wheel loader 100 swing.

As illustrated in FIG. 3, the wheel loader 100 includes the engine 111, the steering cylinders 112, a driving force transmission device 113, a hydraulic pump 114, a control valve 115, a center joint 132C, brakes 133F, 133R, a front differential 134F, a rear differential 134R, a positioning device 141, a pressure sensor 142, a control system 180, and a user interface 190.

As illustrated in FIG. 3, the control system 180 includes an autonomous driving controller 200, a hydraulic controller 160, an engine controller 150, and a travelling controller 170.

The engine 111 is a power source for the wheel loader 100. The engine 111 drives the hydraulic pump 114 and the driving force transmission device 113.

The driving force transmission device 113 transmits the driving force of the engine 111 to the front right tire 131FR and the front left tire 131FL through the center joint 132C and the front differential 134F, and to the rear right tire 131RR and the rear left tire 131RL through the center joint 132C and the rear differential 134R, so as to make the wheel loader 100 accelerate and travel.

The hydraulic pump 114 is driven by the engine 111, thereby supplying hydraulic oil to the control valve 115. The hydraulic oil is distributed by the control valve 115 to drive the steering cylinders 112, the lift cylinders 125, the bucket cylinder 126, and the brakes 133F, 133R. Upon being supplied with the hydraulic oil, the steering cylinders 112, the lift cylinders 125, and the bucket cylinder 126 expand and contract, and this causes change in angle between the front of the vehicle body and the rear of the vehicle body, and in angles of the lift arms 122 and the bucket 121 with respect to the front of the vehicle body, respectively. Furthermore, the brakes 133F, 133R are closed by the hydraulic oil, and this suppresses the rotation of the tires 131FR, 131FL, 131RR, 131RL and thus causes the wheel loader 100 to decelerate and stop.

The positioning device 141 acquires information about the current position of the wheel loader 100. The positioning device 141 is a GNSS (Global Navigation Satellite System). However, the positioning device 141 is not limited thereto. The positioning device 141 may perform positioning by a known SLAM (Simultaneous Localization and Mapping) using a camera or a LiDAR (Light Detection and Ranging) sensor.

The user interface (input device) 190 is a personal computer (PC), a tablet terminal, a smartphone, etc., and may be any other device as long as it can input a work instruction which will be described later.

The autonomous driving controller (controller) 200 generates an engine control signal, a hydraulic control signal, and a travelling control signal in accordance with various instructions (work instruction, evacuation instruction, work restart instruction, etc.) from the user interface 190, the current position information from the positioning device 141, and load information from the pressure sensor 142, and transmits the signals as generated to the engine controller 150, the hydraulic controller 160, and the travelling controller 170, respectively.

In response to these signals, the engine controller 150 controls the rotational speed of the engine 111, the hydraulic controller 160 controls the degree of opening and closing of the control valve 115, and the travelling controller 170 controls the transmission ratio and direction of rotation of the driving force transmission device 113.

The control system 180 is a computer for executing various kinds of information processing relating to the operations of the wheel loader 100, and is implemented by, for example, a microcomputer, etc.

Figure 4:
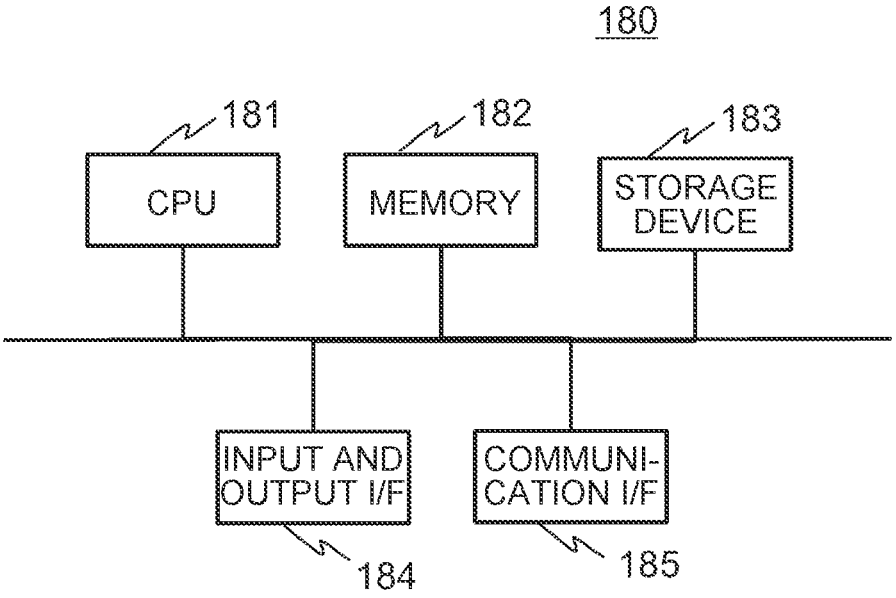
FIG. 4 is a configuration diagram of hardware of a control system according to the first embodiment.

FIG. 4 illustrates hardware configuration of the control system 180. The control system 180 includes a CPU (Central Processing Unit) 181, a memory 182, a storage device 183, and input and output interface (I/F) 184. The control system 180 may further include a communication interface (I/F) 185. The CPU 181, the memory 182, and the storage device 183 may be provided for each section in the control system 180. They may be shared by a plurality of configurations.

The CPU 181 loads a program stored in the storage device 183 into the memory 182 and executes the program. The memory 182 is, for example, a RAM (Random Access Memory), and functions as a work area. The storage device 183 is a ROM (Read Only Memory), a flash memory, etc., and retains programs, data used for processing by the CPU 181, data generated during processing, data generated by processing, etc.

In the present embodiment, for example, the CPU 181 loads programs stored in the storage device 183 into the memory 182 and executes the programs, whereby each function of the control system 180 is implemented.

The input and output I/F 184 is an interface for input and output of data. In the present embodiment, data is input and output to and from the user interface 190. In the present embodiment, an operator of the wheel loader 100 inputs a work instruction, an evacuation instruction, and a work restart instruction through the user interface 190.

Note that the storage device 183 includes a ROM or a flash memory, which is a semiconductor memory, however, alternatively, may include a magnetic storage device such as a hard disk drive.

Figure 5:
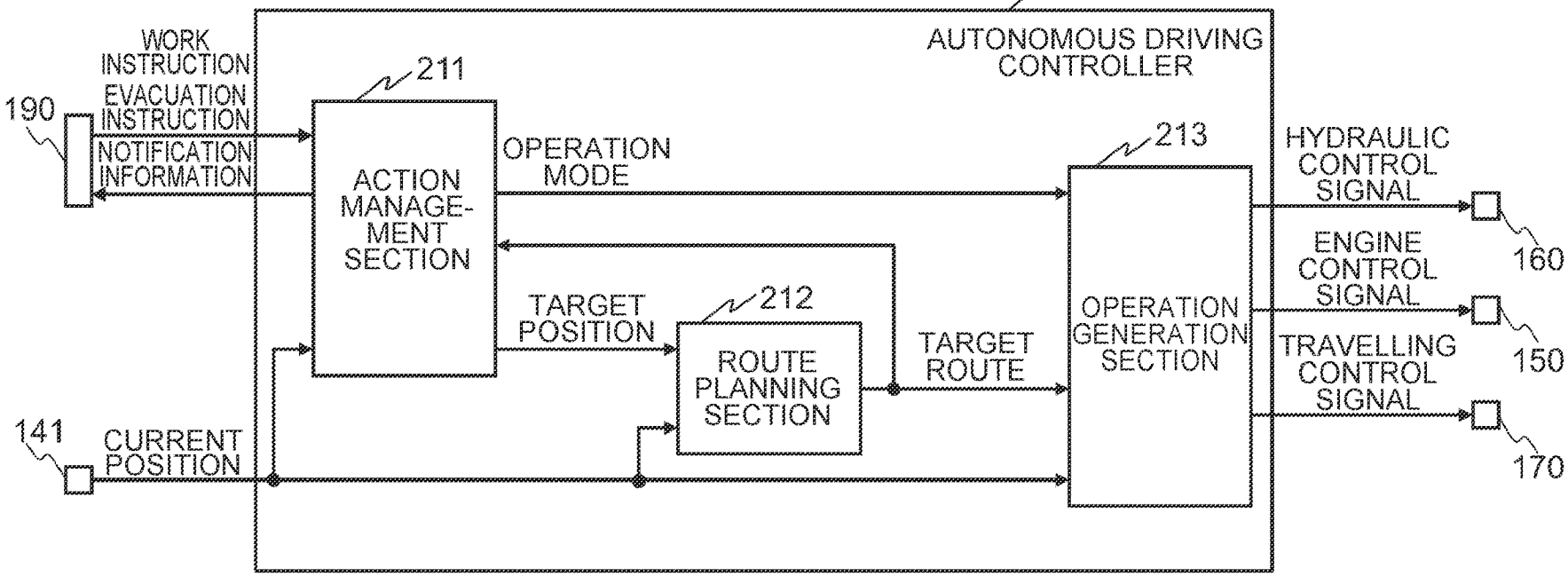
FIG. 5 is a functional block diagram of an autonomous driving controller according to the first embodiment.

Next, the autonomous driving controller 200 will be described. FIG. 5 is a functional block diagram of the autonomous driving controller 200 according to the present embodiment. The autonomous driving controller 200 includes an action management section 211, a route planning section 212, and an operation generation section 213.

The autonomous driving controller 200 further includes a reception section when being configured to receive an instruction from the outside without receiving it through the user interface 190.

The action management section 211 acquires a work instruction, an evacuation instruction, and a work restart instruction, and also a current position, decides an operation mode of the wheel loader 100, transmits the operation mode as decided to the operation generation section 213, sets a target position, and transmits the target position as set to the route planning section 212. Then, the action management section 211 receives a target route from the route planning section 212 in response to the transmission of the target position. The action management section 211 further transmits the operation mode as determined to the user interface 190 as one of the notification information.

The action management section 211 receives the work instruction, the evacuation instruction, and the work restart instruction from the user interface 190. In addition, the action management section 211 receives the current position from the positioning device 141.

The operation mode includes a work mode and an evacuation mode, and the work mode includes a travelling mode, an excavating mode, a loading mode, and a dumping mode. In accordance with the work instruction, the action management section 211 decides, as the operation mode, one of the traveling mode, the excavating mode, the loading mode, and the dumping mode. Upon receiving the evacuation instruction, the action management section 211 decides the evacuation mode as the operation mode. Note that upon receiving a signal indicating that, among the other vehicles, a vehicle of a predetermined type to be avoided has entered the work area 300, the action management section 211 may decide the evacuation mode as the operation mode.

Figures 6A, 6B, 6C:
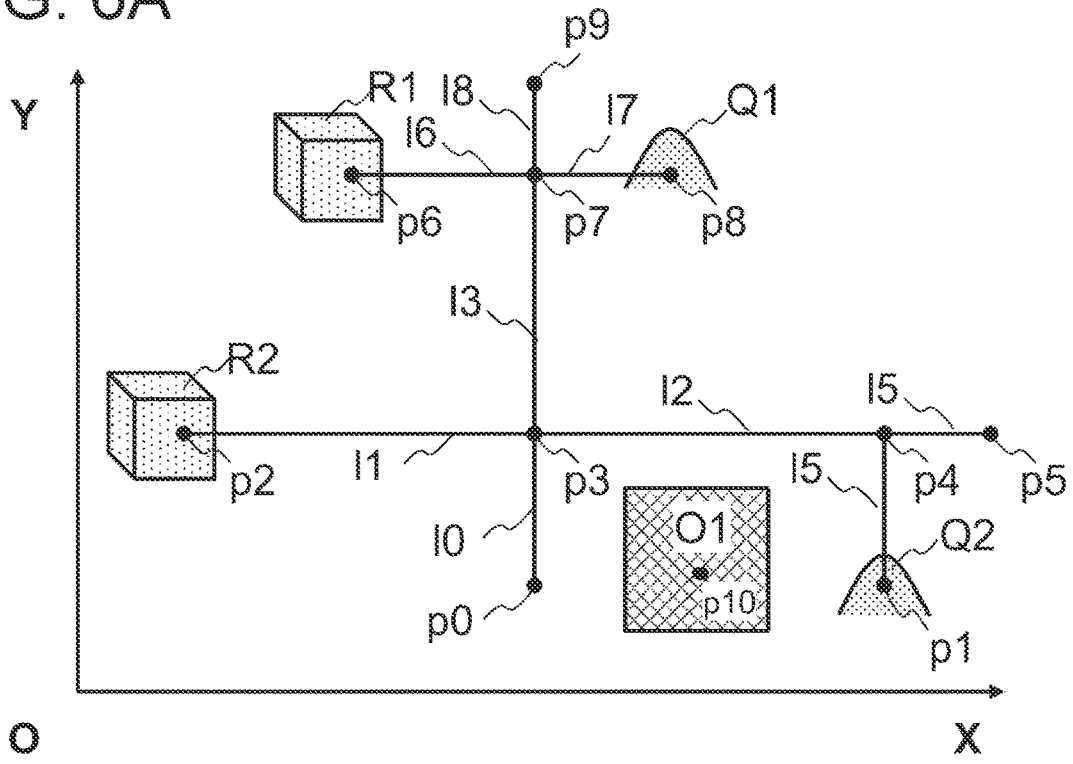
FIG. 6(*a*) to FIG. 6(*c*) are diagrams for explaining map data according to the first embodiment.

The route planning section 212 calculates a target route from a current position of the wheel loader 100 to a target position using map data 220 (see FIG. 6A to FIG. 6C), and transmits the target route to the action management section 211 and the action generation section 213. The route planning section 212 receives the target position from the action management section 211. In addition, the route planning section 212 receives the current position from the positioning device 141.

The operation generation section 213 causes the work machine to travel along the target route, and causes the bucket 121 to operate so as to perform excavation, loading, and dumping.

The operation generation section 213 generates a travelling operation signal for causing the wheel loader 100 to travel along the target route. The operation generation section 213 transmits the traveling operation signal to the traveling controller 170 and the hydraulic controller 160 as a traveling control signal and as a hydraulic control signal, respectively. In addition, the operation generation section 213 generates a work operation signal for causing the bucket 121 to perform excavation, loading, and dumping in accordance with the operation mode.

Furthermore, the operation generation section 213 calculates the necessary rotational speed of the engine based on the traveling operation and the work operation, and transmits the rotational speed of the engine as calculated to the engine controller 150 as an engine control signal. For example, in the same manner as conventional manual operations, the travelling control signal may be the amount of pedal operation of the accelerator and brake, the amount of operation of the steering operation device, and a switching signal of a forward and reverse switch. The hydraulic control signal may be the amount of lever operation of the lift arms 122 and bucket 121.

Next, the map data 220 will be described. FIG. 6(*a*) is a diagram for explaining the map data 220 according to the present embodiment, and FIG. 6(*b*) and FIG. 6(*c*) illustrate examples of the map data 220 according to the present embodiment. The map data 220 is generated in advance and stored in the storage device 183, etc.

The map data 220 includes a plurality of points (Nodes) within the work area 300 and line segments (Arc) connecting them. As illustrated in FIG. 6(*b*), the map data 220 includes coordinates 222 and attributes 223 of points 221, respectively, and as illustrated in FIG. 6(*c*), includes information about end points 225, 226 of line segments 224, respectively. Note that, in FIG. 6(*a*), Q1 and Q2 are excavation targets, R1 and R2 are loading targets, and O1 is an obstacle.

Next, a work instruction 230, a target route 240, and an evacuation instruction 250 will be described.

FIG. 7(*a*) illustrates an example of the work instruction 230. The work instruction 230 includes, for example, an identifier (ID) 231 provided to each work instruction 230, a type of object 232, a target amount of loading 233, a loading position 234, an excavation position 235, and a dumping position 236. The work instruction 230 is created by, for example, a management device, and provided to the wheel loader 100. The action management section 211 sequentially executes the work instructions 230.

For example, the work instruction 230 for an identifier Ins01 is an instruction for repeatedly excavating an object M1 at an excavation position Q1 and loading it onto a loading position R1, and then completing the work after the amount of loading reaches W1.

Upon receiving the work instruction 230 for the identifier Ins01, firstly, the action management section 211 sets the operation mode to the traveling mode, sets the excavation position Q1 (p8) to the target position, and transmits the target position to the route planning section 212. The route planning section 212 generates the target route 240 from the current position to the target position p8, and transmits the target route to the action management section 211 and the action generation section 213.

FIG. 7(*b*) illustrates an example of the target route 240 generated when the current position is a point p3. The target route 240 includes passing points 241 including the positions from the current position to the target position, and FNR 242 indicating a traveling direction between the respective points. In the FNR 242, forward travelling is expressed by F and reversing is expressed by R.

The action management section 211 acquires the current position at a predetermined time interval, and determines whether the target position (p8) and the current position match with each other every time the current position is acquired. Then, when they match with each other, the action management section 211 determines that the wheel loader 100 has arrived at the target position (p8), and sets the operation mode to the excavation mode. While the operation mode is being set to the excavation mode, the action management section 211 acquires the load of the bucket 121 from the pressure sensor 142 at a predetermined time interval to determine whether the amount of change matches the amount of excavation. Then, when they match with each other, the action management section 211 determines that the excavation is completed, and sets the operation mode to the traveling mode. Thereafter, the action management section 211 sets the target position to the loading position R1 (p6), and transmits the target position to the route planning section 212. The route planning section 212 generates the target route 240 from the current position (p8) to the target position (p6).

The action management section 211 acquires the current position at a predetermined time interval, and determines whether the target position (p6) and the current position match with each other every time the current position is acquired. Then, when they match with each other, the action management section 211 determines that the wheel loader 100 has arrived at the target position (p6), and sets the operation mode to the loading mode. While the operation mode is being set to the loading mode, the action management section 211 acquires the load of the bucket 121 from the pressure sensor 142 at a predetermined time interval to determine whether the amount of change matches the amount of loading. Then, when they match with each other, the action management section 211 determines that the loading has been completed, and determines that the work of the work instruction 230 of the identifier Ins01 has been completed.

Upon completion of the work of the identifier Ins01, the action management section 211 proceeds to the work instruction 230 for the subsequent identifier Ins02. The work instruction 230 of the identifier Ins02 is an instruction for excavating an object M2 at an excavation position Q2, loading it onto a loading position R2, and then completing the work after the amount of loading reaches W2.

In these examples, the excavation position and the dumping position are instructed to be the same position. This means that the amount of excess with respect to the target amount is to be dumped into the original excavation position. For example, in the work instruction 230 for the identifier Ins01, when an object remains in the bucket 121 after the amount of loading reaches the target amount of loading W1 at the loading position R1, this remaining object is dumped into the original excavation position Q1. In this case, after loading is performed, the action management section 211 sets the target position to Q1 (p8), provides an instruction to each section, causes the work machine to travel in the same manner as described above, and when determining that the work machine has arrived at the target position (p8), sets the operation mode to the dumping mode so as to cause the work machine to dump.

When loading is performed at the loading position R1, the action management section 211 may calculate a difference ΔW1 between the loaded amount and the target amount of loading W1 to adjust the amount of excavation in the next excavation position Q1 using the difference ΔW1. In this case, the action management section 211 performs control so that the amount of excavation does not exceed the difference ΔW1 during excavation.

FIG. 7(*e*) illustrates an example of the evacuation instruction 250. The evacuation instruction 250 includes, for example, an identifier (ID) 251 provided to each evacuation instruction 250 and an evacuation possible position 252. The evacuation possible position 252 is the information about a position to which the wheel loader 100 in the work area 300 can move off, and points of the map data 220 are registered therein.

For example, in the map data 220 illustrated in FIG. 6(*a*), when a dump truck enters from a point p9 to the work area 300 to bring an object to be excavated to a point p8 and a point p1, the points p9, p7, p8, p3, p4, p1, which connect between the point p9 to the point 8 and the point p9 to the point p1, serve as a work range of the dump truck. In this case, as illustrated in FIG. 7(*e*), the evacuation possible positions 252 of the wheel loader 100 are points p0, p2, p5, p6.

For example, when the transport vehicle 330 such as a dump truck enters the work area 300, the evacuation instruction 250 is created by the management device or the like based on predetermined travel route information for the transport vehicle 330. Furthermore, the evacuation instruction 250 may be created not only based on the travel route information for the transport vehicle 330 but also based on work range information of other work machines that enter the work area 300. In the present embodiment, the evacuation instruction 250 as generated is notified to a user, and the user inputs the evacuation instruction 250 to the autonomous driving controller 200 through the user interface 190.

When the transport vehicle 330 that has entered the work area 300 exits the work area 300, a work restart instruction is output. Upon output of the work restart instruction, the user inputs it to the autonomous driving controller 200 through the user interface 190.

Upon receiving the evacuation instruction 250, the action management section 211 executes the evacuation processing. Specifically, the action management section 211 decides, from among the evacuation possible positions 252, the one which is the closest to the current position as the evacuation position. Then, the action management section 211 transmits, as a target position, the evacuation position as decided to the route planning section 212.

Figure 8:
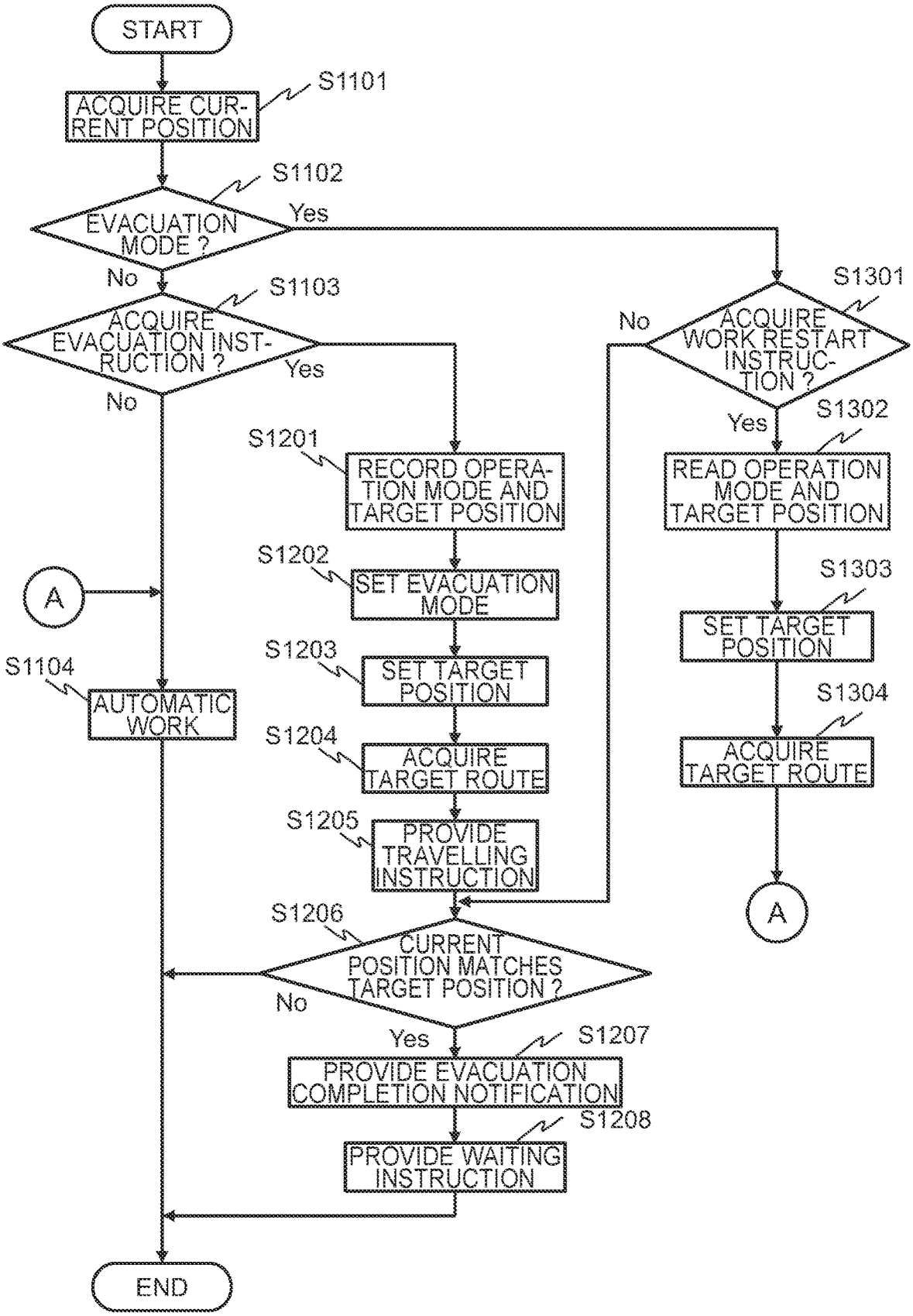
FIG. 8 illustrates a flowchart of action management processing according to the first embodiment.

Next, the action management processing performed by the action management section 211 according to the present embodiment will be described. FIG. 8 illustrates a processing flow of the action management processing according to the present embodiment. This processing is repeated at a predetermined time interval.

Firstly, the action management section 211 acquires the current position from the positioning device 141 (step S1101). When the output cycle of the positioning device 141 is different from the processing cycle of the action management processing, the action management section 211 acquires the latest one from among the current position information output by the positioning device 141.

The action management section 211 determines whether the current operation mode is the evacuation mode (step S1102).

When it is not the evacuation mode (step S1102; No), the action management section 211 determines whether it has received the evacuation instruction 250 from the user interface 190 (step S1103).

When not having received the evacuation instruction 250 (step S1103; No), the action management section 211 performs the calculation processing for executing automatic work (step S1104), and ends the processing. Specifically, the work is executed in accordance with the work instruction 230.

On the other hand, when having received the evacuation instruction 250 in step S1101 (step S1101; Yes), the action management section 211 performs the processing for the case in which the evacuation instruction 250 is newly acquired.

Firstly, the action management section 211 records the current operation mode and the target position in the storage device 183 (step S1201). The target position stored in the storage device 183 is referred to as a final target position.

The action management section 211 sets the evacuation mode as the operation mode (step S1202), and transmits it to the operation generation section 213.

Then, the action management section 211 newly sets the target position (step S1203). Based on the evacuation possible positions 252 provided as the evacuation instruction 250 and the current position information acquired from the positioning device 141, the action management section 211 selects the one which is the closest from among the evacuation possible positions 252, and sets it as the target position.

Thereafter, the action management section 211 transmits the target position to the route planning section 212, and acquires the target route 240 as a reply (step S1204). For example, FIG. 7(*c*) illustrates an example of the target route 240 generated when the evacuation instruction 250 illustrated in FIG. 7(*e*) is received with the current position being the point p3 in the map data 220 illustrated in FIG. 6(*a*). In this case, the action management section 211 selects, as the evacuation position, the point p0 which is the evacuation possible position 252 closest to the point p3. Thus, the target route 240 for reversing from the point p3 to the point p0 is generated.

Then, the action management section 211 outputs a travelling instruction to the operation generation section 213 (step S1205). At this time, the operation mode is the evacuation mode.

Thereafter, the action management section 211 compares the current position with the target position to determine whether the current position matches the target position (step S1206). When they do not match with each other (step S1205; No), the action management section 211 ends the processing as it is. At this time as well, the operation mode is the evacuation mode.

On the other hand, when they match with each other (step S1206; Yes), the action management section 211 notifies the user that evacuation has been completed (step S1207). In this example, the action management section 211 generates an evacuation completion notification and transmits it to the user interface 190. Then, the action management section 211 provides the operation generation section 213 with an instruction to make the work machine 100 remain and at the position and wait (step S1208). At this time as well, the operation mode is the evacuation mode.

In step S1102, when the operation mode is the evacuation mode (step S1102; Yes), the action management section 211 determines whether it has acquired the work restart instruction through the user interface 190 (step S1301).

When not having acquired the work restart instruction (step S1301; No), the action management section 211 proceeds to step S1206 and continues the evacuation operation. On the other hand, when having acquired the work restart instruction (step S1301; Yes), the action management section 211 reads the operation mode that had been executed before evacuation and the final target position, which were recorded in step S1201, from the storage device 183 (step S1302). Then, the action management section 211 sets the final target position as read as the target position (step S1303), and transmits it to the route planning section 212. Then, the action management section 211 acquires, from the route planning section 212, the target route 240 in accordance with the target position that it has transmitted (step S1304), proceeds to step S1104, and causes the automatic work to be restarted.

At this time, the current position is the point p0. For example, in the map data 220 illustrated in FIG. 6(*a*), when Ins01 of the work instruction 230 illustrated in FIG. 7(*a*) is being executed, the final target position is the loading position R1, which corresponds to the point p8 in the map data 220. FIG. 7(*d*) illustrates an example of the target route 240 generated in this case. As illustrated in FIG. 7(*d*), the target route 240 for forward traveling from the point p0 to the point p8 is generated.

As described above, the work machine control system 180 for controlling the operations of a work machine such as the wheel loader 100 according to the present embodiment includes the action management section 211 configured to acquire the work instruction 230, which includes a final target position, and the current position of the wheel loader 100 to set a target position, the route planning section 212 configured to generate the target route 240 between the current position and the target position, and the operation generation section 213 configured to cause the wheel loader 100 to travel in accordance with the target route. Upon receiving the evacuation instruction 250, the action management section 211 decides an evacuation position from among the evacuation possible positions 252 included in the evacuation instruction 250 based on at least one of the current position and the final target position, and sets the evacuation position as the target position.

As described above, the present embodiment enables the work machine to select the optimum evacuation position in accordance with the current position of the own vehicle (wheel loader 100) at the time when receiving the evacuation instruction 250. For example, when a plurality of evacuation possible positions is available, the one which is the closest to the current position is selected as the evacuation position. This enables the evacuation distance to be shorten and thus the time during which the work is being interrupted to be shorten. That is, according to the control system 180 according to the present embodiment, it is possible to minimize decrease in the work efficiency caused by evacuation while avoiding contact with a dump truck or other work machines.

First Modification

In the embodiment described above, the evacuation possible position 252 is included in the evacuation instruction 250. However, the autonomous driving controller 200 may be configured to generate the evacuation possible position. In this case, the autonomous driving controller 200 includes an evacuation possible position generation section configured to generate an evacuation possible position in accordance with the work range information about a vehicle which has entered.

For example, when the transport vehicle 330 or the like enters the work area 300, the evacuation possible position generation section receives the work range information about this vehicle. Based on the work range information, the evacuation possible position generation section identifies the evacuation possible position 252 using the map data 220.

Second Modification

In the embodiment described above, the evacuation possible position which is the closest to the current position is set to an evacuation position, however, which is not limited thereto. For example, the evacuation possible position which is the closest to the final target position may be set to an evacuation position.

Second Embodiment

Next, a second embodiment according to the present invention will be described. In the first embodiment, the evacuation instruction 250 is issued when another vehicle such as the transport vehicle 330 enters the work area 300. In the present embodiment, the evacuation instruction 250 is also issued when an abnormality has occurred in the wheel loader 100.

Hereinafter, the present embodiment will be described focusing on the configuration different from that of the first embodiment.

The configuration of the wheel loader 100 according to the present embodiment is the same as that of the first embodiment. The control system 180 is also the same as that of the first embodiment.

Figure 9:
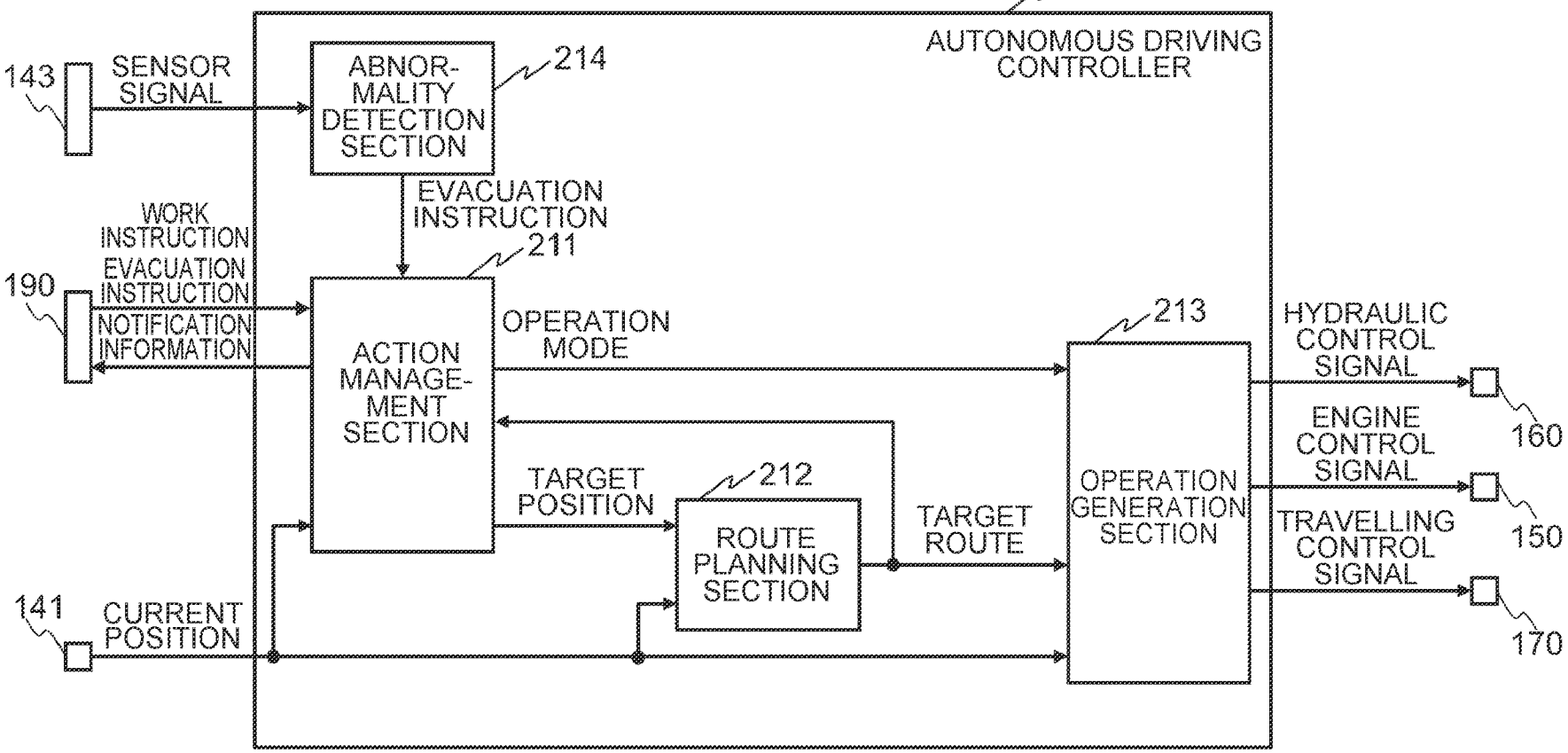
FIG. 9 is a functional block diagram of an autonomous driving controller according to a second embodiment.

The functions of the autonomous driving controller 200 according to the present embodiment will be described. FIG. 9 is a functional block diagram of the autonomous driving controller 200 according to the present embodiment.

As illustrated in FIG. 1, the autonomous driving controller 200 according to the present embodiment further includes an abnormality detection section 214 in addition to the configuration (action management section 211, route planning section 212, and operation generation section 213) according to the first embodiment.

The abnormality detection section 214 checks the soundness of the wheel loader 100, and transmits the evacuation instruction 250 to the action management section 211 when an abnormality is present. The abnormality assumed here is, for example, failure of each equipment of the wheel loader 100, breakage of an electrical, mechanical, or hydraulic connection point, communication delay of a sensor or a controller, etc. The abnormality detection section 214 determines whether there is an abnormality based on sensor signals from various sensors (hereinafter, referred to as mounted sensors 143) installed (mounted) in each section of the wheel loader 100.

The mounted sensors 143 are, for example, a vehicle speed sensor, a steering angle sensor, a positioning device for acquiring an own-position, various pressure sensors (lift, bucket, brake, etc.), and the like. The abnormality detection section 214 determines that there is an abnormality when a sensor signal indicating a condition in which the soundness of an actuator or a peripheral device for realizing operations such as traveling and work cannot be confirmed is output from the mounted sensor.

When having received at least one of the evacuation instruction 250 transmitted from the user interface 190 and the evacuation instruction 250 transmitted from the abnormality detection section 214, the action management section 211 executes the evacuation processing which is the same as that of the first embodiment.

As described above, the control system 180 of the wheel loader 100 according to the present embodiment further includes the abnormality detection section 214 configured to transmit the evacuation instruction 250 to the action management section 211 when having detected the abnormality of the wheel loader 100.

According to the present embodiment, the calculation processing in evacuation described in the first embodiment is carried out not only based on the evacuation instruction 250 from the user but also based on detection of an abnormality of the wheel loader 100. Thus, expanding the application range of the processing in evacuation enables the time during which the work is being interrupted to be shorten in the same manner as the first embodiment even when an abnormality is present, and also the decrease in the work efficiency to be minimized.

Third Embodiment

Next, a third embodiment of the present invention will be described. In the first embodiment and the second embodiment, in evacuation, the evacuation possible position which is the closest to either the current position or the final target position is set as the evacuation position. On the other hand, in the present embodiment, an evacuation possible position which makes the entire travel route shortest is set as an evacuation position.

Here, an example in which, the total travel distance in the case of setting the evacuation possible position closest to the current position as the evacuation position is compared with the total travel distance in the case of setting the evacuation possible position closest to the final target position as the evacuation position so as to decide either of them, will be described.

The wheel loader 100 according to the present embodiment is the same as that of the first embodiment. The control system is also the same as the first embodiment. The functional block and hardware configuration of the autonomous driving controller 200 are also the same as those of the first embodiment. However, the functions of the action management section 211 and route planning section 212 are different from those of the first embodiment.

Upon receiving the evacuation instruction, the action management section 211 according to the present embodiment extracts the evacuation possible position which is the closest to the current position as a first evacuation position candidate in the same manner as the first embodiment.

Furthermore, in the present embodiment, the action management section 211 extracts the evacuation possible position which is the closest to the target position at that time point as a second evacuation position candidate. The action management section 211 transmits the first evacuation position candidate and the second evacuation position candidate to the route planning section 212 together with the current position and the final target position.

Upon receiving a via-point from the action management section 211, the route planning section 212 calculates a target route passing through the via-point. In the present embodiment, upon receiving the evacuation position candidates from the action management section 211, the route planning section 212 calculates targets route from the current position to the final target position via the evacuation position candidates for the evacuation position candidate, respectively, and transmits them to the action management section 211 as the target route candidates.

The action management section 211 decides an evacuation position based on the target route candidates for the evacuation position candidates, respectively, received from the route planning section 212. In this example, the action management section 211 decides the evacuation position candidate having the shortest travel distance calculated based on the target route candidates as the evacuation position. The travel distance is calculated based on the map data 220. Then, the action management section 211 notifies the route planning section 212 of the evacuation position as the target position.

Next, the action management processing performed by the action management section 211 according to the present embodiment will be described. The action management processing by the action management section 211 according to the present embodiment is basically the same as the action management processing according to the first embodiment. However, the process for setting a target position in step S1203 is different from that of the first embodiment.

Figure 10:
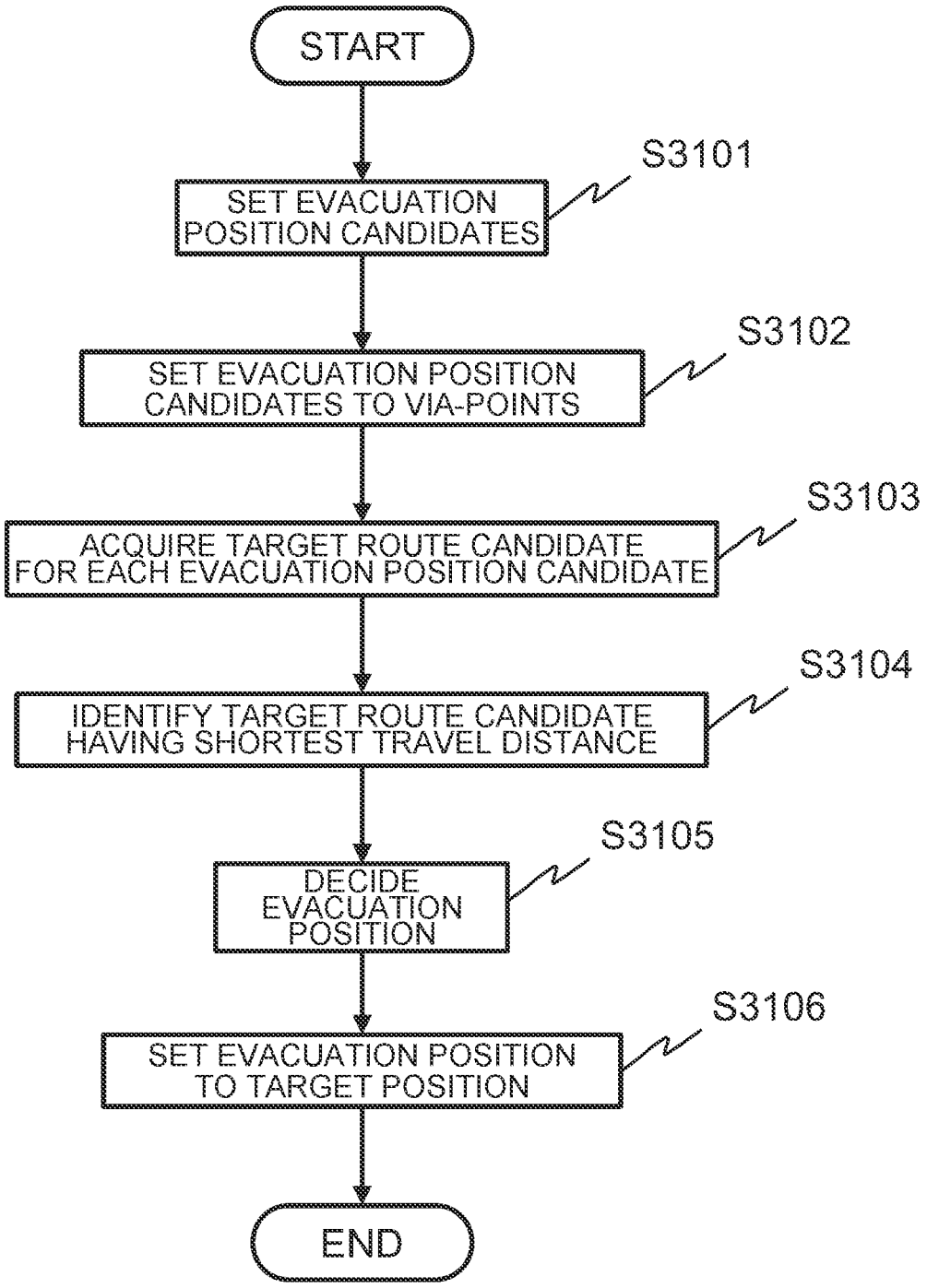
FIG. 10 illustrates a flowchart of target position setting processing according to a third embodiment.

FIG. 10 illustrates a flow of the target position setting process in step S1203 according to the present embodiment, in other words, the target position setting process in the evacuation mode. As illustrated in FIG. 10, firstly, the action management section 211 sets the evacuation position candidates (step S3101). In this example, as described above, from among the evacuation possible positions 252 included in the evacuation instruction 250, the evacuation possible position at the closest distance from the current position and the evacuation possible position at the closest distance from the final target position are extracted as the evacuation position candidates.

In the following, this process will be described referring to a specific example. The evacuation position candidates extracted upon receipt of the evacuation instruction 250 illustrated in FIG. 11(*a*) when the map data 220 illustrated in FIG. 6(*a*) to FIG. 6(*c*) is provided and the current position is the point p0 and the final target position is the point p8 will be described. In the evacuation instruction 250, three positions of the points p2, p5, p6 are registered as the evacuation possible positions 252. The evacuation position candidate (first evacuation position candidate) extracted as the evacuation possible position at the closest distance from the current position p0 is the point p2. The evacuation position candidate (second evacuation position candidate) extracted as the evacuation possible position at the closest distance from the final target position p8 is the point p6.

Thereafter, the action management section 211 sets the evacuation position candidates as extracted as via-points, respectively (step S3102). Here, the evacuation position candidates are transmitted to the route planning section 212 as the via-points, respectively. Then, the action management section 211 acquires the target route candidates for the evacuation position candidates, respectively, as a reply (step S3103).

In the following, the target route candidates generated for the evacuation position candidates, respectively, in the specific example will be described. When the first evacuation position candidate p2 is the evacuation position, the target route candidate (first target route candidate) that reaches the final target position p8 from the current position p0 via the first evacuation position candidate p2 is generated. FIG. 11(*b*) illustrates the first target route candidate 240*a*. As illustrated in FIG. 11(*b*), the first target route candidate 240*a* goes from the point p0 to the point p2 with F (forward), from the point p2 to the point p0 via the point 3 with R (reverse), and then to the point p8 with F.

When the second evacuation position candidate p6 is the evacuation position, the target route candidate (second target route candidate) that reaches the final target position p8 from the current position p0 via the second evacuation position candidate p6 is generated. FIG. 11(*c*) illustrates the second target route candidate 240*b*. As illustrated in FIG. 11(*c*), the second target route candidate 240*b* goes from the point p0 to the point p6 via the point p3 and the point p7 with F, to the point p9 via the point p7 with R, and then to the point p8 via the point p7 with F.

Next, the action management section 211 calculates the travel distances of the target routes, respectively, and identifies the target route candidate having the shortest travel distance (step S3104). In this example, for each of the first target route candidate 240*a* and the second target route candidate 240*b*, the action management section 211 calculates the distance between the points using the coordinate values of the respective points, and define the total value as the travel distance.

Then, the action management section 211 decides, as the evacuation position, the evacuation position candidate in the target route candidate as identified (step S3105). Then, the action management section 211 sets the evacuation position as decided to the target position (step S3106).

The other processes are the same as those of the first embodiment, and thus the explanation therefor will be omitted.

As described above, according to the control system 180 of the wheel loader 100 of the present embodiment, the action management section 211 decides, from among the target route candidates which reach the final target position from the current position via a plurality of evacuation position candidates, respectively, selected from the evacuation possible positions 252, the evacuation position candidate included in a target route candidate having the shortest traveling distance as the evacuation position.

As described above, according to the present embodiment, from among the plurality of evacuation possible positions, a route in which the total travel distance is the shortest in the entire work instruction executed by the wheel loader 100 is selected. This enables the time during which the work is being interrupted due to the evacuation to be shorten, and thus decrease in the work efficiency caused by the evacuation to be shorten while avoiding contact with a dump truck or other work machines.

Third Modification

In the embodiment described above, only the evacuation possible position which is the closest to the current position and the evacuation possible position which is the closest to the final target position are extracted as the evacuation position candidates, however, the present invention is not limited thereto. For example, all the evacuation possible positions may be extracted.

In this case, in step S3101, the action management section 211 extracts all the evacuation possible positions as the evacuation position candidates, and transmits them to the route planning section 212. Then, the route planning section 212 calculates the target route candidates for all the evacuation position candidates (evacuation possible positions) and transmits them back to the action management section 211.

The action management section 211 calculates the travel distances for all the target route candidates, respectively, selects the one with the shortest travel distance from among them, decides the evacuation position candidate (evacuation possible position) used in the target route candidate as the evacuation position, and sets it to the target position.

Fourth Modification

Note that, in the same manner as the second embodiment, the abnormality detection section 214 may be provided in the present embodiment.

Sixth Modification

Furthermore, in each of the embodiments and modifications described above, the example in which the work instruction 230, the evacuation instruction 250, and the work restart instruction are input by a user through the user interface 190 has been described, however, the manner for acquiring these instructions is not limited thereto. For example, the autonomous driving controller 200 may include a reception section to directly receive the data through the reception section. The reception section is implemented by the communication I/F 185. In this case, the management device or the like creates these instructions and transmits them to the autonomous driving controller 200.

Furthermore, instead of the evacuation instruction 250, information indicating that another vehicle to be avoided, such as the transport vehicle 330, has entered the work area 300 and information identifying the work area of the other vehicle may be received. In this case, the action management section 211 identifies an evacuation possible position based on the information above and the map data 220.

In the above, the embodiments of the present invention have been described in detail, however, the present invention is not limited thereto but includes various modifications.

For example, in the embodiment described above, the present invention is applied to the wheel loader 100, however, objects to which the present invention is applied are not limited thereto. The present invention is also applicable to a work machine other than the wheel loader 100, such as a hydraulic excavator. In particular, applying the present invention to a dump truck or the like with the large capacity for loading enables improvement in the efficiency since the travel distance for evacuation can be minimized.

The embodiments described above have been described in detail for the purpose of explaining the present invention clearly, and embodiments are not necessarily limited to those having all the configurations described above.

The present invention is not limited to the embodiments described above, and various modifications can be made without departing from the concept of the present invention, and all technical matters included in the technical idea described in the claims are included in the scope of the present invention. While the embodiments described above have been explained as preferable examples, those skilled in the art could make various alternatives, modifications, variations, and improvements based on the disclosure herein, and those fall within the scope of the appended claims.

REFERENCE SIGNS LIST

100: work machine (wheel loader), 110: vehicle body, 111: engine, 112: steering cylinder, 113: driving force transmission device, 114: hydraulic pump, 115: control valve, 120: working device, 121: bucket, 122: lift arm, 123: bell crank, 124: bucket link, 125: lift cylinder, 126: bucket cylinder, 131: tire, 131FL: front left tire, 131FR: front right tire, 131RL: rear left tire, 131RR: rear right tire 132C: center joint, 133F: brake, 133R: brake, 134F: front differential, 134R: rear differential, 141: positioning device, 142: pressure sensor, 143: mounted sensor, 150: engine controller, 160: hydraulic controller, 170: travelling controller, 180: control system, 181: CPU, 182: memory, 183: storage device, 184: input and output I/F, 185: communication I/F, 190: user interface (input device),

200: autonomous driving controller (controller), 211: action management section, 212: route planning section, 213: operation generation section, 214: abnormality detection section, 220: map data, 221: point, 222: coordinate, 223: attribute, 224: line segment, 225: end point, 226: end point, 230: work instruction, 231: identifier (ID), 232: type, 233: target amount of loading, 234: loading position, 235: excavation position, 236: dumping position, 240: target route, 240*a*: first target route candidate, 240*b*: second target route candidate, 241: passing point, 242: FNR, 250: evacuation instruction, 251: identifier (ID), 252: evacuation possible position,

300: work area, 310: excavation target, 320: loading target, 330: transport vehicle

The invention claimed is:

1. A work machine control system, comprising:

a controller configured to cause the work machine to operate, wherein the controller includes:

an action management section configured to acquire a work instruction, which includes information about a work to be executed by the work machine, and a current position of the work machine so as to set a target position based on the work instruction and the current position, a route planning section configured to generate a target route between the current position and the target position, and an operation generation section configured to cause the work machine to travel in accordance with the target route, and wherein the action management section is configured to:

receive an evacuation instruction including evacuation possible positions based on a work range of another work machine that is different from the work machine, when the other work machine enters the work area of the work machine, and upon receiving the evacuation instruction, decide an evacuation position from among the evacuation possible positions based on the work range of the other work machine and the current position of the work machine so as to set the evacuation position to the target position.

2. The work machine control system according to claim 1, wherein the controller further includes an abnormality detection section configured to acquire a signal relating to an abnormality of the work machine, and transmit the evacuation instruction to the action management section upon detecting the abnormality of the work machine.

3. The work machine control system according to claim 1, wherein the action management section decides, as the evacuation position, one of the evacuation possible positions which is the closest to the current position.

4. The work machine control system according to claim 1, wherein the work instruction includes information about a final target position, and wherein the action management section decides, from among target route candidates which reach the final target position from the current position via a plurality of evacuation position candidates, respectively, selected from the evacuation possible positions, an evacuation position candidate included in a target route candidate having a shortest traveling distance as the evacuation position.

5. The work machine control system according to claim 4, wherein the action management section selects, as the plurality of evacuation position candidates, a first evacuation position candidate that is an evacuation possible position closest to the current position and a second evacuation position candidate that is an evacuation possible position closest to the final target position.

6. The work machine control system according to claim 1, wherein upon arrival of the work machine at the evacuation position, the action management section outputs information indicating completion of an evacuation operation to an input device for inputting the work instruction.

7. A work machine, comprising:

a controller configured to cause the work machine to operate, wherein the controller includes:

an action management section configured to acquire a work instruction, which includes information about a work to be executed by the work machine, and a current position of the work machine so as to set a target position based on the work instruction and the current position, a route planning section configured to generate a target route between the current position and the target position, and an operation generation section configured to cause the work machine to travel in accordance with the target route, and wherein the action management section is configured to:

receive an evacuation instruction including evacuation possible positions based on a work range of another work machine that is different from the work machine, when the other work machine enters the work area of the work machine, and upon receiving the evacuation instruction, decide an evacuation position from among the evacuation possible positions based on the work range of the other work machine and the current position of the work machine so as to set the evacuation position to the target position.

* * * * *